US007011468B1

(12) United States Patent
Leventhal

(10) Patent No.: US 7,011,468 B1
(45) Date of Patent: Mar. 14, 2006

(54) FLUID DISPENSING DEVICE

(75) Inventor: James M. Leventhal, Newton, MA (US)

(73) Assignee: Clio Designs Incorporated, Watertown, MA (US)

( * ) Notice: Subject to any disclaimer, the term of this patent is extended or adjusted under 35 U.S.C. 154(b) by 42 days.

(21) Appl. No.: 10/645,010

(22) Filed: Aug. 21, 2003

Related U.S. Application Data

(60) Provisional application No. 60/405,009, filed on Aug. 21, 2002.

(51) Int. Cl.
*A46B 11/04* (2006.01)
*A47L 13/22* (2006.01)

(52) U.S. Cl. ..... 401/287; 401/286; 401/137; 132/116

(58) Field of Classification Search ..... 401/136–138, 401/190, 282, 284–291; 132/112–116
See application file for complete search history.

(56) References Cited

U.S. PATENT DOCUMENTS 2,988,822 A * 9/1961 Birch et al. ..... 401/190
3,602,601 A * 8/1971 Zenger et al. ..... 401/190
4,557,619 A * 12/1985 DeVincentis ..... 401/190
4,934,855 A * 6/1990 Recchelbacher ..... 401/137
4,938,621 A * 7/1990 Pyrozyk ..... 401/289
5,909,737 A 6/1999 Ricco ..... 132/116
5,927,290 A * 7/1999 Thiruppathi ..... 132/116
6,158,442 A 12/2000 Piatetsky ..... 132/115
6,257,246 B1 * 7/2001 Kan ..... 132/112
6,276,367 B1 8/2001 Piatetsky ..... 132/115
6,672,313 B1 * 1/2004 Battaglia et al. ..... 132/112

* cited by examiner

*Primary Examiner*—Tuan Nguyen
(74) *Attorney, Agent, or Firm*—Mintz Levin Cohn Ferris Glovsky and Popeo, P.C.

(57) ABSTRACT

A fluid dispensing device configured as a brush is provided. The device includes a hollow barrel having a plurality of bristles disposed along its surface and a plurality of openings in fluid communication with a chamber defined therein. The barrel is engaged to a hollow handle defining a chamber configured to contain an enclosed pressurized fluid reservoir containing a quantity of fluid. A user switch disposed along a surface of the device helps to discharge a volume of pressure from the fluid reservoir to thereby discharge a volume of fluid. The brush dispenses the volume of discharged fluid through the plurality of openings as a fluid spray or a fluid mist. In one embodiment according to the invention, the device permits a user to apply and to distribute a fluid through their hair, while the user brushes and/or styles their hair with the device.

26 Claims, 7 Drawing Sheets

FLUID DISPENSING DEVICE

CLAIM OF PRIORITY TO PRIOR APPLICATIONS

This application claims priority under 35 U.S.C. § 119(e) to U.S. provisional application Ser. No. 60/405,009, filed on Aug. 21, 2002, which is incorporated herein by reference.

FIELD OF THE INVENTION

The present invention relates generally to devices for dispensing a fluid spray or mist. More particularly, the invention provides a portable, cordless fluid spraying or misting device configured as a brush.

BACKGROUND OF THE INVENTION

Hairbrushes generally and round hairbrushes specifically are used to style, smooth and detangle hair. A conventional hairbrush typically includes a handle at its proximal end and at its distal end a portion to hold a plurality of bristles. The proximal end of the brush is often a shaped handle and is constructed of any one or a combination of materials. The distal end is often shaped, for instance, as a round or paddle-like conformation, and is similarly constructed of any one or a combination of materials. Bristles can be constructed of synthetic materials, as well as natural materials and fibers. The length and the distribution of bristles of a brush can vary widely, depending on the type of hairbrush design, the aesthetic appeal sought, or the styling effect desired.

Hairbrushes are generally used in a hair styling process and are often used in conjunction with water or other hair products to achieve a desired styling effect. Dry hair is often difficult to style with a hairbrush and can be more easily styled when it is wet. Therefore, adding water to a hair styling process can ease styling and can be beneficial in terms of achieving a desired effect, reducing the amount of time required and the materials necessary to style hair.

For these reasons, many people prefer to style their hair when it is wet, styling hair after bathing and/or adding water to their hair during a styling process. Adding water to hair can include, for instance, manually applying water to hair or spraying water from a portable, pump-action spray bottle. Applying water manually or from a spray bottle during a styling process, while brushing and styling hair with a brush and/or a blow dryer, often requires substantial manual finesse. Typically, moistening hair and styling hair with a brush are steps performed separately and repeated many times until hair is adequately moistened and styled in a desired fashion. For many people, this process is difficult.

Traveling with hairbrushes and a portable spray bottle can be cumbersome. In addition, use of hairbrushes and a portable spray bottle to style hair away from home or in a public restroom can be inconvenient. In particular, in the work place, people are likely to prefer a discreet means of brushing and styling their hair when necessary.

Thus, a means of conveniently, discreetly, and quickly moistening hair while styling hair without drawing attention to one is desirable.

Prior art hairbrush designs provide methods for moistening and brushing hair including a liquid dispensing hairbrush disclosed in U.S. Pat. No. 5,927,290. The liquid dispensing hairbrush includes a spray mechanism that allows a user to spray a liquid from a bristle area of the hairbrush. This device requires a user to coordinate multiple manual pumping actions of the spray mechanism with multiple manual hairstyling, e.g., brushing, actions, while requiring the user to aim the spray mechanism at a desired area of hair.

U.S. Pat. No. 5,909,737 discloses a combination brush and hairspray system for allowing a user to simultaneously brush and apply hairspray to their hair using only one hand. The combination includes a fluid chamber connected to a plurality of delivery tubes operatively connected to a pump.

The devices disclosed in U.S. Pat. Nos. 5,927,290 and 5,909,737 include a short trigger mechanism that permits the device to deliver a small volume, and often a heavy flow or ration, of fluid from a reservoir. In many instances, the device potentially delivers either too little fluid or water and the effect is counter-productive, or too much fluid or water at one location that produces messy results. In addition, the short trigger mechanism requires a user to pump the trigger many times or repeatedly during a styling process, which action, as noted, can be ineffective and ultimately can be tiresome.

A device disclosed in U.S. Pat. No. 5,746,531 is configured to store and to dispense fluid from a proximal end of a hairbrush handle, rather than from a portion of the brush containing bristles. A user of this device is not able to simultaneously spray their hair with a fluid or water while brushing their hair.

U.S. Pat. Nos. 6,158,442 and 6,276,367 disclose hairbrush devices that store fluid in a head of a hairbrush and dispense the fluid from tips of each or several of a plurality of bristles that is connected at a distal end of the hairbrush. As fluid is generally dispensed from the tips of bristles, such a hairbrush design effectively delivers fluid or water to a user's scalp rather than through the user's hair.

While the prior art devices discussed above may provide a user with some functionality with respect to styling hair, such devices do not permit a user to automatically and/or continuously apply a fluid or water spray or mist to their hair, while simultaneously brushing their hair. Thus, it is desirable to have a fluid dispensing device configured as a brush to permit a user to apply a fluid spray or mist to his/her hair during brushing. In addition, it is desirable that such a fluid dispensing device provides a substantially moderate and relatively even distribution of fluid or water throughout hair while it is being brushed.

SUMMARY OF THE INVENTION

In an aspect of the invention, a fluid dispensing brush comprises a body defining a first chamber and a second chamber, the body having a plurality of openings defined in at least a portion of its outer surface in fluid communication with the first chamber and a plurality of bristles projecting therefrom. The dispensing brush further comprises a fluid assembly contained in the second chamber, the fluid assembly having an enclosed pressurized reservoir configured to maintain a quantity of fluid under pressure and further having an actuator disposed and configured to discharge a volume of pressure from the pressurized reservoir when actuated such that a volume of fluid is discharged from the pressurized reservoir. The brush also comprises a nozzle contained in the first chamber, the nozzle having one or more holes defined in at least a portion of its outer surface in fluid communication with the first chamber, the nozzle being configured and connected to the pressurized reservoir such that the nozzle receives at least a portion of the volume of fluid discharged from the pressurized reservoir and the one or more holes discharge the volume of fluid into the first chamber as one of a fluid spray and a fluid mist, wherein the plurality of openings vents the fluid from the brush.

Implementations of the invention may include one or more of the following features. The body of the brush includes a barrel portion defining the first chamber and a handle portion defining the second chamber. The actuator includes a valve operatively connected to a first end of the pressurized reservoir and configured to discharge pressure from the pressurized reservoir when actuated. The brush further includes a switch disposed in the outer surface; the switch being further disposed and configured to couple with the valve such that movement of the switch from a first position to a second position actuates the valve. The switch is disposed in the outer surface along the handle portion. Movement of the switch from the first position to the second position includes depressing the switch. The pressurized reservoir further includes a pressurized gas cartridge configured to contain a compressed gas and operatively connected to the pressurized reservoir such that an interior of the gas cartridge is in fluid communication with an interior of the pressurized reservoir. The pressurized gas cartridge is disposed and configured to release a volume of compressed gas into the interior of the pressurized reservoir. The compressed gas can include compressed air, compressed $N_2O$ or compressed $CO_2$.

Implementations of the invention may further include one or more of the following features. Each hole of the nozzle is sized and configured, and wherein the actuator is further configured to discharge the volume of pressure with sufficient force, such that the nozzle discharges the fluid volume of fluid as one of fine fluid droplets and ultra-fine fluid droplets. Each hole has a span ranging from about 0.4 mm to about 1.0 mm. Each hole of the nozzle is sized and configured, and wherein the actuator is further configured to discharge the volume of pressure with sufficient force, such that the nozzle discharges the volume of fluid as one of an atomized spray and an atomized fluid mist. The nozzle can further include a hollow elongated tube configured to extend from the first chamber into the second chamber, and further configured to place an interior of the nozzle in fluid communication with the interior of the pressurized reservoir.

Other embodiments of the invention may include the barrel portion and the handle portion configured such that the barrel portion is removably connected to the handle portion. The barrel portion can define a circular cylinder, and the handle portion can define a circular cylinder. The plurality of bristles can be distributed along the outer surface of the cylinder such that the plurality of bristles defines a round brush. The plurality of openings can be distributed along the outer surface of the cylinder such that the fluid vents from a circumferential perimeter of the circular cylinder. In another embodiment, the barrel portion can define a paddle-shaped conformation having a first side and a second side, wherein the plurality of bristles and the plurality of openings are disposed along at least a portion of the first side.

In another aspect of the invention, a fluid dispensing brush comprises a body defining a chamber, the body having a plurality of openings defined in at least a portion of its outer surface in fluid communication with the chamber and a plurality of bristles projecting therefrom; a fluid assembly contained in a first portion of the chamber, the fluid assembly having an enclosed pressurized reservoir configured to maintain a quantity of fluid under pressure and further having an actuator disposed and configured to discharge a volume of pressure from the pressurized reservoir when actuated such that a volume of fluid is discharged from the pressurized reservoir; and a nozzle contained in a second portion of the chamber, the nozzle having one or more holes defined in at least a portion of its outer surface in fluid communication with the chamber, the nozzle being configured and connected to the pressurized reservoir such that the nozzle receives at least a portion of the volume of fluid discharged from the pressurized reservoir and the one or more holes discharges the volume of fluid into the chamber as one of a fluid spray and a fluid mist, wherein the plurality of openings vents the fluid from the brush.

In still another aspect of the invention, a fluid dispensing brush comprises a body defining a chamber; at least a portion of an outer surface of the body defining a plurality of openings in fluid communication with the chamber and having a plurality of bristles projecting therefrom; means contained by the body within the chamber to contain and to maintain a quantity of fluid under pressure; means contained by the body within the chamber to discharge a volume of pressurized fluid; and means contained by the body within the chamber to receive the volume of fluid discharged and to vent the volume of fluid through the plurality of openings.

Implementations of the invention may further include one or more of the following features. Means to contain and to maintain the quantity of fluid under pressure includes an enclosed reservoir configured to contain the quantity of fluid and a compressed gas cartridge operatively connected to the enclosed reservoir such that an interior of the compressed gas cartridge is in fluid communication with an interior of the enclosed reservoir. The compressed gas cartridge can be configured to contain a quantity of compressed gas and further configured to release a volume of the compressed gas into the interior of the enclosed reservoir to maintain the quantity of fluid contained therein under pressure. Means to discharge the volume of pressurized fluid includes a valve disposed and configured such that when the valve is actuated the volume of pressurized fluid is released. The valve can be further disposed and further configured to mate with a switch disposed along the outer surface such that movement of the switch from a first position to a second position actuates the valve. Means to receive the volume of fluid discharged and to vent the volume of fluid through the plurality of openings includes a nozzle disposed in the chamber having one or more holes defined in its outer surface in fluid communication with the plurality of openings. Each hole can be disposed and configured to discharge the volume of fluid as one of a fluid spray and a fluid mist.

Various aspects of the invention may provide one or more of the following advantages. Improved styling capability of a traditional hairbrush can be provided and can be incorporated with a variety of hairbrush styles and designs. Fluids and/or fluid sprays or mists can be dispensed from a brush and applied throughout a user's hair in a continuous and/or intermittent manner during a hair drying, styling and/or brushing process, and can be directed to areas of a user's hair that require fluid. Fluids and/or fluid sprays or mists can be applied to a user's hair as a spray or mist of fine or ultra-fine fluid droplets, or as an atomized fluid spray or mist. Application of a fluid to a user's hair as a fluid spray or mist helps to minimize/reduce an application of fluid as a heavy fluid stream. Fluids and/or fluid sprays or mists can be dispensed from a brush and applied to a user's hair when the user styles his/her hair with the brush to achieve a substantially moderate and relatively even distribution of fluid throughout the user's hair. A fluid can be dispensed from a brush and applied to a surface or substrate, e.g., hair, in a desired spray or mist pattern, e.g., projecting from the brush as a substantially radially projecting 3600 pattern or a substantially outward projecting pattern, to vary the extent of coverage of the fluid spray or mist on the surface or substrate. Application of fluids and/or fluid sprays or mists can be portable and repeatable, and can be done in locations without access to electricity. Easy assembly and disassembly of a fluid dispensing brush can be provided to refill or replace one or more components of the brush required to discharge and/or to apply an application of fluid or fluid spray or mist.

These and other advantages of the invention, along with the invention itself, will be more fully understood after a review of the following figures, and detailed description.

DETAILED DESCRIPTION OF THE INVENTION

For purposes of illustration, embodiments of the invention will be described with reference to a hairbrush constructed and arranged to dispense a fluid spray or mist for use in brushing, drying and styling hair, as shown in FIGS. 1–8. Those skilled in the art will appreciate that embodiments of the invention are not limited to a hairbrush, but also may include a variety of brushes or devices for dispensing fluid designed for use in other applications.

Figure 1:
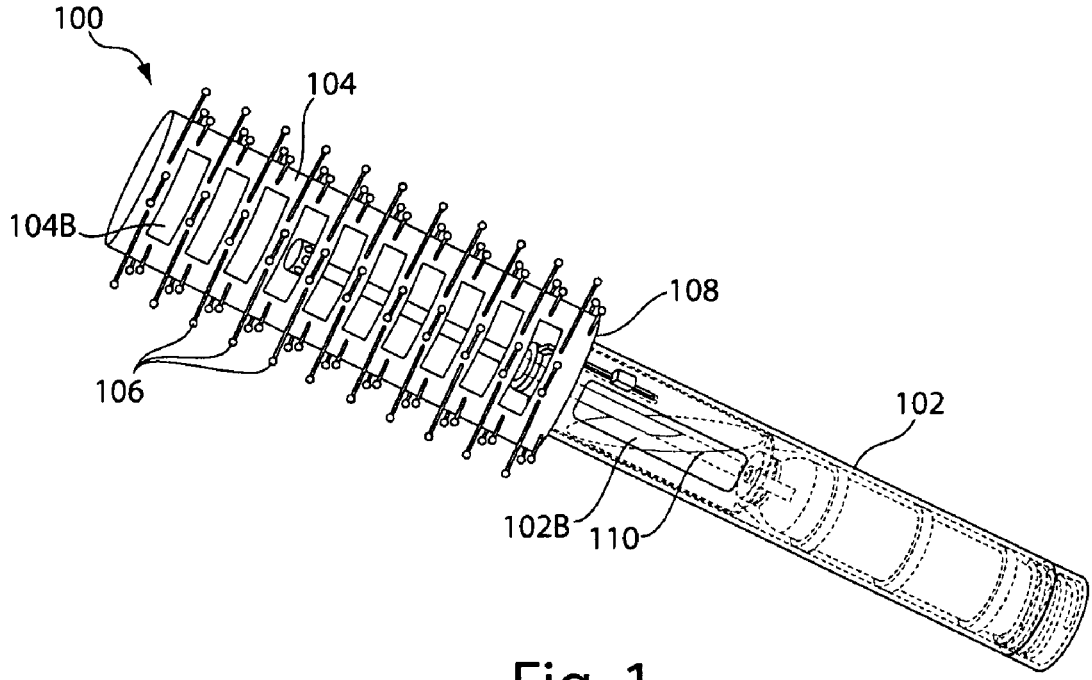
FIG. 1 is a perspective view of one embodiment of a fluid dispensing device according to the invention.
Figure 2A:
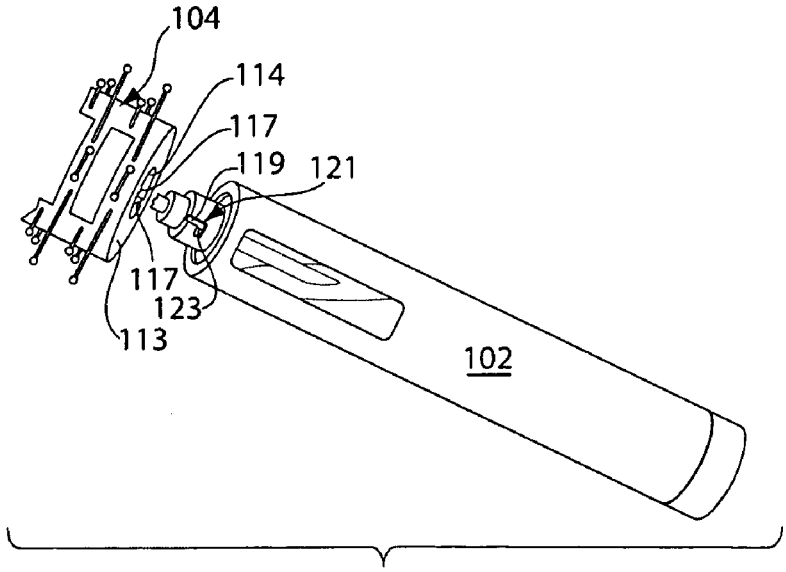
FIG. 2A is a partial perspective view of the device shown in FIGS. 1–2 illustrating the barrel disengaged from the handle.
Figure 2:
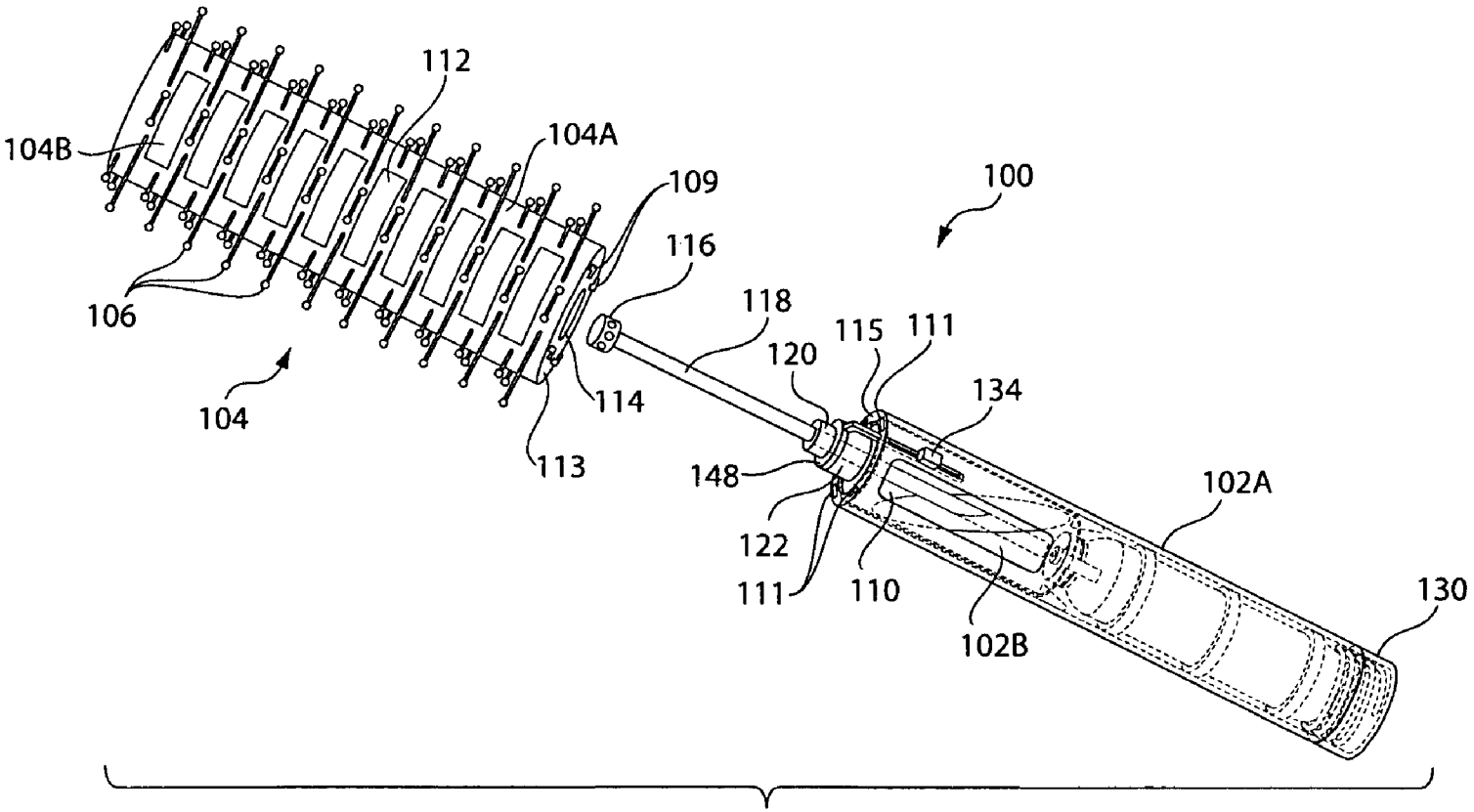
FIG. 2 is an exploded perspective view of the device shown in FIG. 1 illustrating a barrel including a plurality of bristles disengaged from a handle.
Figure 4:
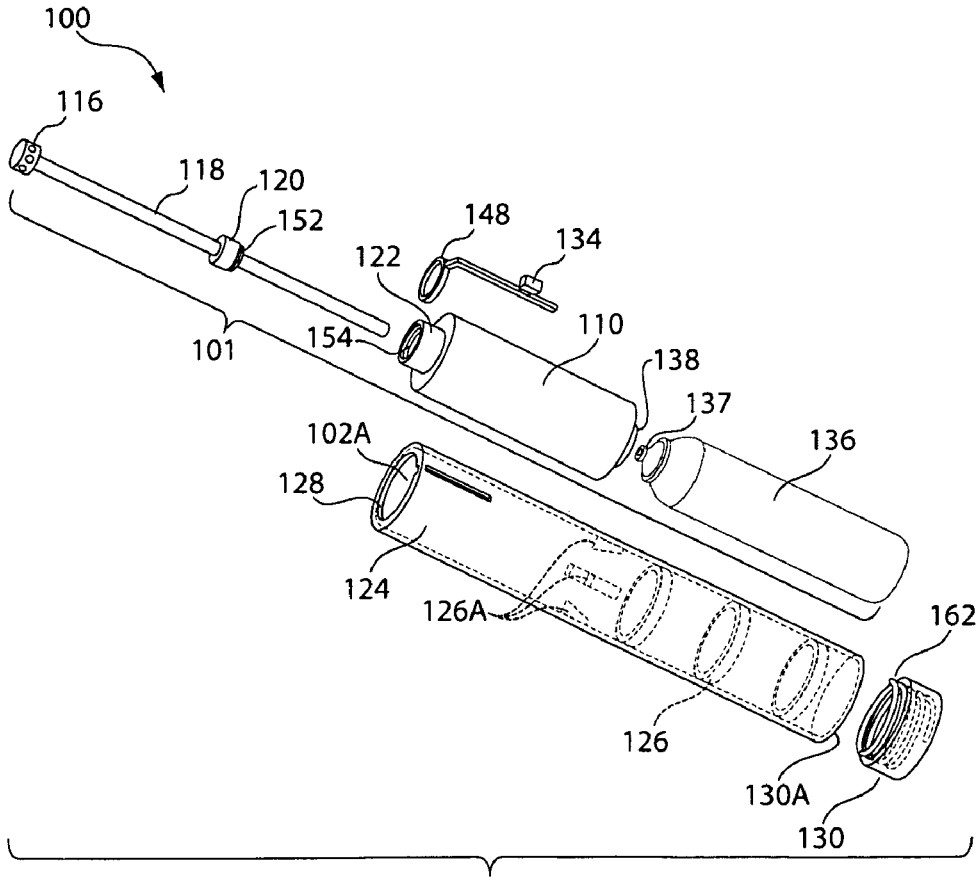
FIG. 4 is an exploded perspective view of the fluid misting assembly shown in FIG. 3.

Referring to FIGS. 1–2, one embodiment of the invention provides a portable, cordless fluid dispensing device 100 configured as a hairbrush. The device 100 includes a hollow barrel 104 removably connected to a hollow handle 102. The barrel 104 defines an interior chamber 104B and includes at least a portion of an outer surface 104A having a plurality of openings 112 and a plurality of bristles 106 disposed therein. The handle 102 is disposed at a proximal end of the barrel 104 and defines an interior chamber 102A configured to contain a fluid misting assembly 101, as shown in FIG. 4. The assembly 101 is configured to dispense a fluid spray or mist from the barrel 104 when the device 100 is actuated. The device 100 can be configured to help to deliver a substantially moderate and relatively even distribution of fluid spray or mist throughout a user's hair during use of the device 100. The fluid misting assembly 101 can include a nozzle 116, a dip tube 118, a screw collar 120, an actuator switch 134, an actuator valve 122, an enclosed, refillable fluid reservoir 110, and a pressurized gas cartridge 136 (not shown). The cartridge 136 is in fluid communication with an interior chamber defined by the reservoir 110 to pressurize the interior of the reservoir 110 and its fluid contents. Upon actuation of the device 100, a fluid spray or mist is discharged from the reservoir 110 and dispensed from the plurality of openings 112 of the barrel 102. The device 110 thereby delivers a fluid spray or mist to a user's hair during brushing and styling of the user's hair with the device 110. Other embodiments are within the scope of the invention.

The barrel 104 and the handle 102 are each constructed and arranged such that the components can be readily engaged to form the device 100 and disengaged to separate the barrel 104 from the handle 102. The barrel 104 and the handle 102 can be disengaged to provide access to elements of the fluid misting assembly 101 for various purposes including, for instances, refilling or replacing the reservoir 110 or checking the level of fluid contained within the reservoir 110.

In one embodiment of the invention, a proximal end 113 of the barrel 104 and a distal end 115 of the handle 102 are constructed and arranged to removably couple and to securely connect the barrel 104 to the handle 102. The proximal end 113 of the barrel 104 defines an opening 114 configured and sized to receive at least a portion of the distal end 115 of the handle 102. The portion of the distal end 115 of the handle 102 can be configured such that when it is inserted into the opening 114, the portion of the distal end 115 mates with an inner surface immediately adjacent to the opening 114 to removably couple the barrel 104 to the handle 102.

As shown in FIG. 2, in one embodiment, the portion of the distal end 115 and the inner surface adjacent to the opening 114 can be further configured to define a groove/notch-type combination that will permit the barrel 104 and the handle 102 to be removably and securely connected. For instance, the distal end 115 of the handle 102 can include one or more tabs, ribs or other protrusions 111 configured for mating with corresponding slots or grooves 109 defined in the inner surface adjacent to the opening 114. The slots or grooves 109 can be configured to receive the one or more tabs or ribs where the distal end 115 of the handle 102 and the proximal end 113 of the barrel 104 are coupled, and can be sized to insure that when coupled the tabs or ribs 111 mate with the surfaces of the slots or grooves 109 to achieve a close fit.

Where the distal end 115 of the handle 102 is inserted into the opening 114, the distal end 115 can be rotated, e.g., clockwise, until each of the one or more slots or grooves receives and mates with one of the tabs or ribs, thereby engaging the groove/notch combination and securely connecting the handle 102 to the barrel 104. Rotating the handle 102 in an opposite direction, e.g., counterclockwise, can disengage the groove/notch combination to separate the handle 102 from the barrel 104.

Referring to FIG. 2A, in another embodiment of the invention, the barrel 104 and the handle 102 are removably connected by a combination of one or more protruding tabs or notches 117 and one or more grooves 119. In one embodiment, the one or more protruding tabs or notches 117 are disposed along the inner surface adjacent to the opening 114 defined at the proximal end of the barrel 104. Each protruding tab or notch 117 is sized and configured such that a groove 119 defined in the portion of the distal end 115 of the handle 102 receives the tab or notch 117 when the portion of the distal end 115 is inserted into the opening 114.

As shown in FIG. 2A, the portion of the distal end of the handle 102 can include one or more grooves 119 to receive one or more tabs or notches 117 of the barrel 104. In one embodiment, each groove 119 defines an L-shape such that an L-shaped groove path 121 is provided. When each tab or notch 117 is inserted into a corresponding groove 119, the L-shaped groove 119 is sized and configured to receive the tab or notch 117 and to guide the tab or notch 117 along the groove path 121, requiring the barrel 102 or the handle 104 to be rotated, e.g., clockwise, to permit the tab or notch 117 to be fully inserted and to mate with an end of the groove path 121. In one embodiment, each guide path 121 further includes a groove bump 123. The groove bump 123 provides a resistance to insertion of the tab or notch 117 along the groove path 121 and requires a user apply some manual force or pressure to overcome the groove bump 123 to fully insert and to mate the tab or notch 117 with the end of the groove path 121. In one embodiment, the groove bump 123 is configured to help to maintain the tab or notch 117 in its position to thereby help to securely connect the barrel 104 to the handle 102. The groove 119 configuration requires a user to rotate, e.g., counterclockwise, the barrel 104 or the handle 102 to disconnect the barrel 104 from the handle 102. Coupling of the tabs or notches 117 and the grooves 119 thereby permits the barrel 104 and the handle 102 to be removably and securely connected.

The barrel 104 is designed and configured to define any desired or required conformation. As shown in FIG. 1, in one embodiment of the invention, the barrel 104 defines a substantially circular cylinder, usually referred to as a "round hairbrush", with the plurality of bristles 106 and the plurality of openings 112 distributed around the outer surface 104A of the barrel 104. As described below with respect to other embodiments, the invention is not limited with respect to the conformation of the barrel 104 and anticipates that the barrel 104 can define a variety of shapes and configurations. The barrel 104 conformation may be limited only by the size and the configuration of its interior chamber 104B required to accommodate dispensing elements of the fluid misting assembly 101.

The interior chamber 104B of the barrel 104 is sized and configured to receive at least a portion of one or more of the dispensing elements of the fluid misting assembly 101. In one embodiment, the chamber 104B is sized and configured to receive and contain the nozzle 116 and a portion of the dip tube 118. When the device 100 is actuated, a fluid is discharged from the reservoir 110 and is dispensed into the dip tube 118 and ultimately from the nozzle 116 and the openings 112 of the barrel 104. The chamber 104B is sized and configured to permit a fluid discharged from the nozzle 116 to permeate through the openings 112.

The openings 112 of the barrel 104 define a vented surface along at least a portion of the outer surface 104A. Each opening 112 is in fluid communication with the interior chamber 104B and an area external to the barrel 104 to permit gas, e.g., air, and/or a fluid, e.g., water, to permeate or dispense from the chamber 104B. When the device 100 is actuated, the actuator valve 122 causes a volume of pressure to discharge from the reservoir 110, which causes a volume of fluid to discharge from the reservoir 110 into the dip tube 118 and the nozzle 116. The nozzle 116 discharges the volume of fluid as a fluid spray or mist into the chamber of the barrel 104 and from the openings 112 of the barrel 104. In one embodiment, the openings 112 can define a repeating pattern or a random array along at least a portion of the outer surface 104A.

As shown in FIG. 1, and as described above, in one embodiment, the barrel 104 can define a round hairbrush and can include the openings 112 distributed substantially around its outer surface 104A. In this case, the openings 112 dispense a fluid spray or mist from the barrel 104 in different directions along its circumferential perimeter such that a fluid pattern radiates from the barrel 104 that substantially approaches a circular or 360° spraying or misting pattern. The distribution of the openings 112 thereby, in part, helps to dispense a substantially moderate and relatively even distribution of a fluid spray or mist throughout a user's hair when the user brushes his/her hair with the device 100.

Similarly, in one embodiment, the plurality of bristles 106B can define a repeating pattern or a random array along at least a portion of the outer surface 104A. A distribution or pattern of the bristles 106 can depend, in part, on an application in which the device 100 is to be used or a desired or required aesthetic appeal or design of the device 100.

Like the barrel 104, the handle 102 is designed and configured to define any desired or required conformation. As shown in FIG. 1, in one embodiment, the handle 102 defines a substantially circular cylinder. The invention is not limited with respect to the conformation of the handle 102 and anticipates that the handle 104 can define a variety of shapes and configurations, and may further include a texturized outer surface or other surface conformations to help to provide a comfortable and secure manual grip of the device 100. The handle 102 conformation may be limited only by the size and the configuration of its interior chamber 104B that are required to accommodate the fluid misting assembly 101. The handle 102 can further include an interior surface defining the chamber 102A that is configured to securely mount and maintain the assembly 101 within the chamber 102A, as described below in further detail.

Figure 3:
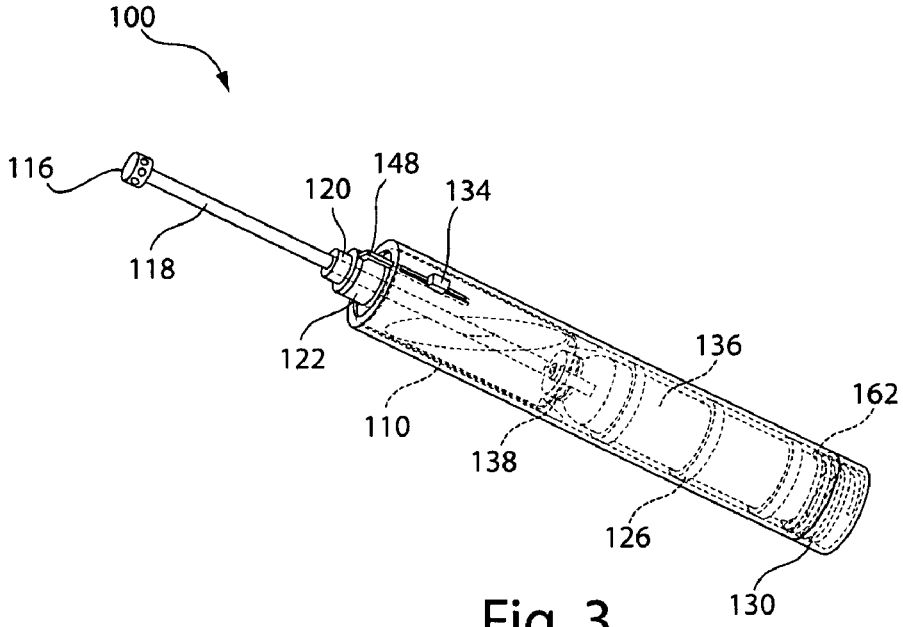
FIG. 3 is a perspective view of the handle shown in FIGS. 1–2 including a fluid misting assembly disposed therein.

Referring to FIGS. 3–4, and as noted above, the fluid misting assembly 101 can include the nozzle 116, the dip tube 118, the screw collar 120, the switch 134, the actuator valve 122, the enclosed, refillable fluid reservoir 110, and the pressurized gas cartridge 136. However, the invention is not limited to those elements of the fluid misting assembly 101 described herein, and anticipates other elements and configurations of the assembly 101 that can help to pressurize the interior chamber of the reservoir 110, discharge a volume of pressure and consequently a volume of fluid from the reservoir 110, and/or vent the volume of fluid, e.g., as a fluid spray or mist, from the device 100. As shown in FIG. 3, the pressurized gas cartridge 136 is connected to a proximal end of the reservoir 110. The reservoir 110 is connected via the actuator valve 122 and the screw collar 120 to the dip tube 118 and the nozzle 116. As described below in further detail, the cartridge 136 contains a compressed gas and discharges at least a volume of such gas into the interior of the reservoir 110 to pressurize the interior of the reservoir 110 and its fluid contents. When a user actuates the actuator valve 122, e.g., by manually depressing or shifting the switch 134, a volume of the pressurized fluid contents discharges from the interior of the reservoir 110 and into the dip tube 118 and the nozzle 118. The nozzle 118 discharges the volume of fluid as a fluid spray and mist into the chamber 104B of the barrel and out through the plurality of openings 112 such that the fluid spray or mist vents from the device 100.

As shown in FIG. 3, when coupled, the reservoir 110 and the cartridge 136 are configured and sized such that at least a portion of the chamber 102A of the handle 102 receives and contains these components. An inner surface of the handle 102 defining the chamber 102A includes one or more ribs 126 configured to help to guide the insertion of the reservoir 110 and the cartridge 136 into the chamber 102A, and to help to securely dispose the reservoir 110 and the cartridge 136 within the handle 102. In one embodiment, the one or more ribs 126 are continuous and extend laterally around a perimeter of the inner surface of the handle 102 such that the ribs 126 define a circular, an elliptical, or a concave-shaped cross section. As shown in FIG. 3, in one embodiment, the handle 102 includes three ribs 126 defined by the inner surface of the chamber 102A to help to securely dispose the cartridge 136 within the chamber 102A, which, in effect, helps to securely dispose the reservoir 110 within the chamber 102A.

As shown in FIG. 4, in one embodiment, the inner surface of the chamber 102A can further include one or more protruding tabs 126A disposed and configured to couple with the proximal end of the reservoir 110. The tabs 126A are defined in the inner surface such that when the reservoir 110 is disposed within the chamber 102A, the proximal end of the reservoir 110 mates with at least a portion of each of the protruding tabs 126A and is thereby positioned within the chamber 102A to receive the cartridge 136.

As shown in FIG. 4, in one embodiment, the inner surface of the chamber 102A defines an additional rib 128 at the distal end 115 of the handle 102 to help to position and to securely maintain the reservoir 110 in its position within the chamber 102A. The ribs 126, 128, in particular, help to securely maintain the reservoir 110 and the cartridge 136 in position within the chamber 102A, for instance, during pressurization of the reservoir 110 interior by the cartridge 136, and during refill of the reservoir 110 at the distal end 115 of the handle 102.

With further reference to FIG. 3, in one embodiment of the invention, the reservoir 110 is joined to a portion of the inner surface of the chamber 102A of the handle 102 and/or to one or more of the ribs 126, 128 such that the reservoir 110 is not removable from the handle 102.

Figure 5:
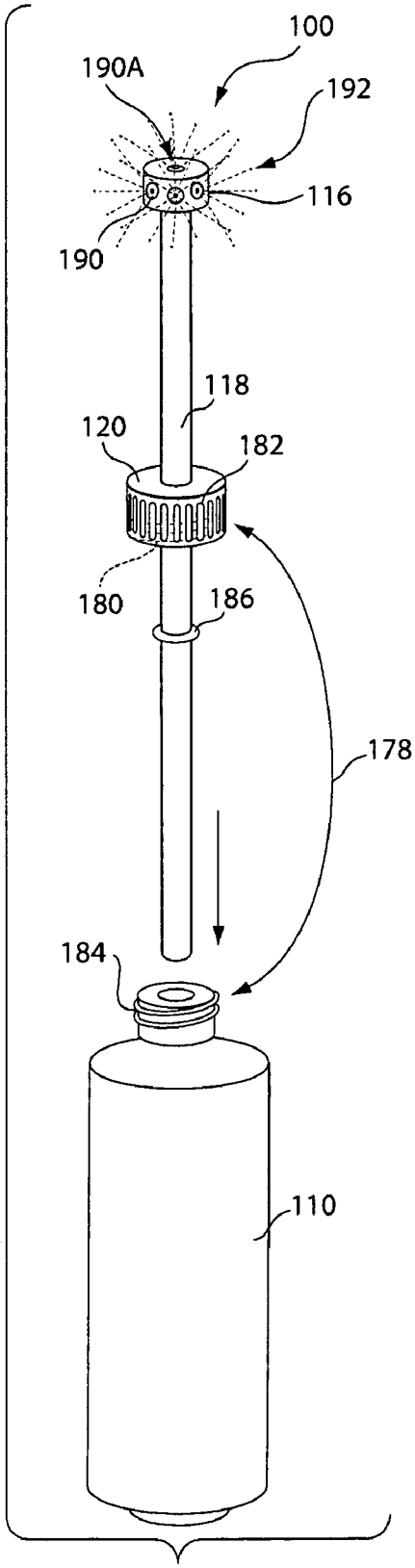
FIG. 5 is a perspective view of one embodiment of a nozzle, a dip tube and a screw collar of the fluid misting assembly shown in FIGS. 3–4.

Referring to FIG. 5, and with further reference to FIGS. 3–4, the nozzle 116 is disposed at the distal end of the dip tube 118. When the device 100 is assembled, the dip tube 118 extends into the interior chamber 104B of the barrel 102 such that at least a portion of the dip tube 118 and the nozzle 116 are disposed therein. The nozzle 116 is further disposed and configured to emit or discharge fluid as a fluid spray or mist, e.g., a spray or mist consisting of fine or ultra-fine droplets or an atomized fluid spray or mist. The nozzle 116 discharges the fluid spray or mist into the chamber 102A and through the plurality of openings 122 of the barrel 104, and ultimately to a user's hair.

In one embodiment, the nozzle 116 is configured to emit or discharge a fluid spray or mist, e.g., in a substantially circular-like pattern or in a pattern that radiates from the nozzle 116 at about 360° along its perimeter. In one embodiment, the nozzle 116 is configured as a substantially circular-shaped, disk-like element 116 that defines a plurality of holes 190 in an outer perimeter or a circumferential edge of the nozzle 116. The distribution of the holes 190 helps to discharge a fluid spray or mist as a pattern substantially radiating at about 360° from the nozzle 116. Embodiments of the invention in which the barrel 104 is a round cylinder and the openings 112 are defined and distributed around the barrel 104, the openings 112 would dispense a fluid spray or mist in substantially a number of directions or angles from the round-shaped barrel 104 in a pattern substantially radiating at about 360°. In one embodiment, the circular-shaped nozzle 116 further defines one or more additional holes 190A in a first outer surface of the nozzle 116 opposite to a second outer surface that couples to the dip tube 118.

Each hole 190, 190A is sized and configured to affect a volume of fluid the nozzle 116 discharges. In one embodiment, the holes 190,190A are sized and configured to help to prevent/minimize discharge of a fluid from the nozzle 116 as a heavy stream or pattern of fluid. In one embodiment, the holes 190, 190A have very small spans or narrow diameters to help to increase/maximize the extent fluid is discharged as a spray or mist and/or to help to increase/maximize the extent fluid is atomization when forced through and discharged from each hole 190, 190A. In one embodiment, each hole 190, 190A can define a span or diameter of from about 0.4 mm to about 1.0 mm. In addition, the number and/or the distribution of the holes 190, 190A can help to increase/maximize the extent of fluid atomization.

Figure 5A:
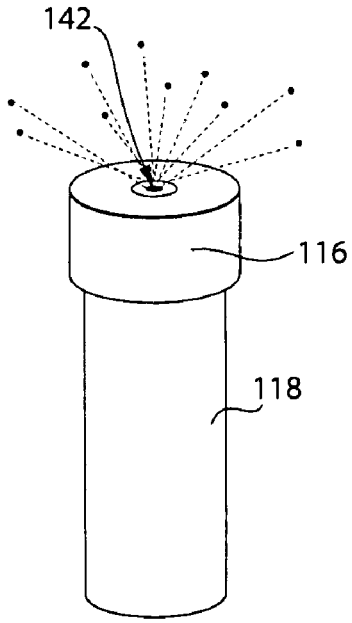
FIGS. 5A–5B are perspective views of another embodiment of the nozzle of the fluid misting assembly shown in FIGS. 3–4 including a dispensing valve.
Figure 5B:
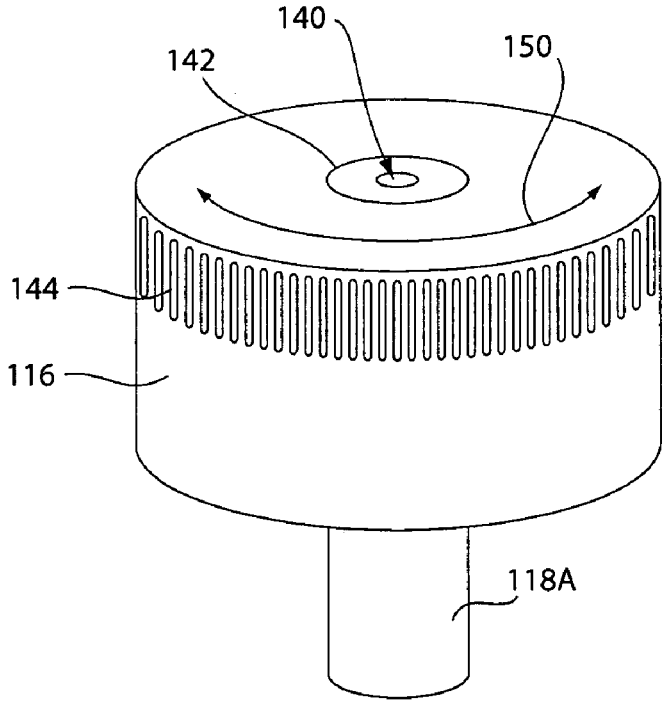

Referring to FIGS. 5A–5B, in another embodiment of the invention, the nozzle 116 is configured and arranged such that turning the nozzle 116 in a bi-directional orientation, as shown by arrow 150 in FIG. 5B, helps to adjust, e.g., increase or decrease, a size of an opening 140 defined in the nozzle 116. Adjusting the size of the opening 140 thereby helps to adjust a volume of fluid discharged and/or helps to discharge fluid as a spray, a mist or an atomized spray or mist. In this case, the nozzle 116 provides a dispensing valve 142 coupled with the opening 140. The dispensing valve 142 and the opening 140 are disposed in fluid communication with the dip tube 118 and are configured to dispense fluid from the nozzle 116. As shown in FIG. 5A, in one embodiment, the dispensing valve 142 and the opening 140 are disposed in the first outer surface of the nozzle 116 opposite to its second surface coupled with the dip tube 118. As shown in FIG. 5B, in one embodiment, the dispensing valve 142 and the opening 140 are disposed in fluid communication with the dip tube 118 via a dip tube extension 118A, e.g., an elongate or tapered portion of the distal end of the dip tube 118 configured such that the dispensing valve 142 couples or receives the extension 118A.

When the nozzle 116 is turned in a bi-directional orientation, as shown by arrow 150 in FIG. 5B, the dispensing valve 142 actuates to adjust, e.g., increase or decrease, a size of the opening 140 and thereby to adjust a volume and/or nature of fluid discharged from the nozzle 116. In one embodiment, the dispensing valve 142 is configured and arranged to dispense fluid as a spray, a mist or an atomized spray or mist. In one embodiment, the dispensing valve 142 is configured and arranged to define the opening 140 with a span or diameter ranging from about 0.4 mm to about 1.0 mm. In another embodiment, the dispensing valve 142 is further configured and arranged to permit the nozzle 116 to be turned such that the dispensing valve 142 closes the opening 140 substantially completely to prevent fluid discharge. The invention anticipates that the dispensing valve 142 may be any type of valve know in the art suitable for use with the nozzle 116 and for increasing and decreasing a span or diameter of the opening 140 to affect a volume and extent of atomization of a fluid discharged from the nozzle 116, and/or to substantially completely open and close the opening 140 of the nozzle 116.

As shown in FIG. 5B, in one embodiment, the nozzle 116 further includes a plurality of ridges 144 defined along at least a portion of its outer perimeter surface to provide a user grip to help a user to turn the nozzle 116 to adjust a volume and nature of fluid discharged from the nozzle 116.

Referring further to FIGS. 3–5, the dip tube 118 is an elongated, hollow member coupled to a distal end of the reservoir 110. A portion of the dip tube 118 inserts through an opening of the actuator valve 122 disposed at the distal end of the reservoir 110 in fluid communication with the interior of the reservoir 110. The dip tube 118 extends into the interior of the reservoir 110 at a length sufficient such that the dip tube 118 is in communication with the fluid contents of the reservoir 110 and positioned at a depth sufficient to receive a volume of fluid discharged from the pressurized reservoir 110 interior when the device 100 is actuated.

The dip tube 118 is removably coupled and securely connected to the reservoir 110 by a screw collar 120. The collar 120 is disposed at a position along the dip tube 118 such that when the collar 120 is coupled with the distal end of the reservoir 110 and the dip tube 118 is inserted into the reservoir 110 interior, an optimal length of the dip tube 118 extends into the reservoir 110, as described above.

The collar 120 couples with the distal end of the reservoir 110 by sets of corresponding threads disposed along the collar 120 and at the distal end of the reservoir 110. As shown in FIG. 5, a first set of threads 180 is defined along an inner surface of the collar 120 at its proximal end that are configured and sized to couple with and connect to a second set of threads 184 defined at the distal end of the reservoir 110. The collar 120 is positioned over the distal end of the reservoir 110 and the first and the second set of threads 180, 184 mate when the collar 120 is rotated along the second set of threads 184, thereby removably and securely connecting the dip tube 118 to the reservoir 110. The collar 122 and its position along the dip tube 118 help to insure that the length of the portion of the dip tube 118 extending into the reservoir 110 is sufficient for the dip tube 118 to contact the fluid contents of the reservoir 110 and to receive a volume of fluid discharged from the reservoir 110.

In one embodiment, the dip tube 118 and the collar 122 are constructed as a single unit. The dip tube 118 and the collar 122, in this case, are constructed of a material suitable for use in moist and wet conditions and to withstand a degree of wear and tear as a consequence of, for instance, engaging and disengaging the fluid misting assembly 101 from the handle 102. A suitable material includes, but is not limited to, plastic, whereby a plastic molding or injection-molding method or process well known in the art can be used to form the dip tube 118 and the collar 122. As a single unit, the depth of the dip tube 118 extending into the interior of the reservoir 110 is substantially insured.

A ring 186 is disposed along the dip tube 118 below the collar 120. When the dip tube 118 is connected to the reservoir 110, the ring 186 helps to permit the dip tube 118 to extend into the reservoir 110 at a depth sufficient to help the dip tube 118 receive a volume of fluid discharged from the pressurized interior of the reservoir 110 upon actuation of the device 100, as noted above. The ring 186 is sized and configured such that it mates along the distal end of the reservoir 110.

In addition, the collar 120 can further include a washer or an O-ring (not shown) disposed along an inner surface of the collar 120 at its distal end to help to provide a seal that helps to minimize/reduce a loss of pressure and/or gas from the reservoir 110 during the pressurization of the reservoir 110 interior. Alternatively, the ring 186 can be constructed of a material suitable for providing sealing properties similar to a washer or an O-ring.

The collar 120 can further include one or more ribs 182 defined in its outer surface and extending vertically along the outer surface to help to serve as a manual grip for a user. The ribs 182 can further help a user engage and disengage the dip tube 118 from the reservoir 110, for instances, to refill or to replace the reservoir 110.

With further reference to FIGS. 3–4, the switch 134 is disposed along and mounted in an outer surface of the handle 104. In one embodiment, the switch 134 is disposed posterior to the actuator valve 122. The switch 134 is disposed and configured to select and to actuate one or more operation settings or functions of the device 100. In one embodiment, the switch 134 is further disposed in the outer surface of the handle 104 such that the switch 134 is positioned over or in alignment with at least a portion of an actuator conduit 148 disposed within the interior of the handle 102. As shown in FIG. 3, the actuator conduit 148 is configured to contact or to couple with the actuator valve 122 and to extend from the distal end of the reservoir 110 into the chamber 102A of the handle 102, e.g., to be disposed along an outer surface of the reservoir 110.

In one embodiment, when the switch 134 is actuated, the switch 134 contacts the actuator conduit 148, which in turn contacts and actuates the actuator valve 122. When engaged, the actuator valve 122 causes a discharge of fluid from the pressurized reservoir 110, and when disengaged the valve 122 does not cause a fluid discharge. In one embodiment, the switch 134 is configured such that manually actuating, e.g., depressing or shifting, the switch 134 causes the switch 134 to contact the actuator conduit 148 and to depress or shift the actuator conduit 148 into an actuated position. When the actuator conduit 148 is depressed or shifted into an actuated position, the movement of the actuator conduit 148 to such a position causes the actuator valve 122 to become actuated, e.g., depressed or shifted. The actuation, or the depressing or shifting movement, of the actuator valve 122 causes a release or discharge of a volume of pressure from the pressurized interior of the reservoir 110 and a resultant simultaneous discharge of a volume of its fluid contents into the dip tube 118 and from the nozzle 116. Fluid is dispensed from the reservoir 110 with a dispensing force sufficient to help to dispense the fluid through the nozzle 116 and the openings 112 as a fluid spray or mist, e.g., of fine or ultra fine droplets or as an atomized fluid spray or mist. The dispensing force is a consequence of the pressurized state of the interior of the reservoir 100 just before the actuator valve 122 actuates release pressure and fluid from the reservoir 110.

The switch 134 is disposed and configured such that manually actuating, e.g., depressing or shifting, the switch 134 a certain number of times and/or in a certain direction causes the device 100 to be in one or more operation settings or functions, such as, for instance, an "ON" setting, an "OFF" setting and/or a "MIST" setting.

In one embodiment, the switch 134 is disposed and configured such that when a user manually depresses the switch 134 continuously the device 100 dispenses a continuous fluid spray or mist from the barrel 104. In one embodiment, the switch 134 is disposed and configured such that when the switch 134 is depressed manually, the switch 134 remains depressed, which essentially places the device 100 in a "MIST" setting whereby the device 100 dispenses a fluid spray or mist continuously, until such time as the switch 134 is depressed a second time to release the switch 134 and to place the device 100 in an "OFF" setting to discontinue dispensing. In another embodiment, the switch 134 is disposed and configured such that depressing the switch 134 intermittently causes the device 100 to intermittently discharge a fluid spray or mist. The invention anticipates that the switch 134 can be disposed and configured such that shifting the switch 134, rather than depressing the switch 134, from a first to a second position and/or from a second to a first position can place the device 100 in similar operation settings to actuate misting functions as described above.

In another embodiment of the invention, the switch 134 is disposed and configured such that when the switch 134 is shifted from a first "OFF" position to a second "ON" position, the switch 134 is positioned such that when the switch 134 is manually depressed, the switch 134 places the device 100 in a "MIST" setting and causes the device 100 to dispense continuously and/or intermittently a fluid spray or mist.

The invention is not limited to the configuration of the switch 134 nor to the arrangement of the switch 134 and the actuating conduit 148 as described above for actuating one or more settings or functions of the device 100, and anticipates that the switch 134, the actuating conduit 148 and/or other actuating mechanisms can be incorporated into the device 100 and/or the assembly 101 to provide the necessary or desired fluid dispensing operation settings to meet a required or preferred mode of dispensing a fluid spray or mist from the device 100.

As noted above, and with further reference to FIGS. 3–4, the reservoir 110 is disposed in the chamber 102A of the handle 102 anterior to the gas cartridge 136 and is connected to the dip tube 118 via the collar 120. The collar 120 helps to position and to stabilize the reservoir 110 within the chamber 102A during pressurization of the reservoir 110. The reservoir 110 defines an interior sized and configured to contain a required or desired volume of fluid.

The reservoir 110 is disposed and configured such that to inspect or to refill the reservoir 110, the barrel 102 need only be disengaged from the handle 102 and the collar 120 and the dip tube 118 disconnected and removed from the distal end of the reservoir 110. In one embodiment, at least a portion of a side wall of the reservoir 110 is constructed of a clear material suitable for providing a visual inspection of the reservoir 110 interior. In one embodiment, the portion of the side wall of the reservoir 110 is constructed of a clear material including, but not limited to, a translucent/transparent polycarbonate or plastic to permit visual inspection of the reservoir 110 interior and, in particular, to permit visual inspection of a level of the fluid contents contained within the reservoir 110. In one embodiment, the reservoir 110 can be entirely constructed of a translucent/transparent polycarbonate or plastic.

As shown in FIG. 1, in one embodiment, a portion of a side wall of the handle 102 is configured as a window-like structure 102B and is constructed of a clear material, such as those materials noted above. The clear window-like structure 102B is disposed and configured in the side wall of the handle 102 such that the structure 102B is positioned adjacent to and substantially aligned with the clear portion of the reservoir 110 to permit visual inspection of the reservoir 110 interior and the level of its fluid contents without disengaging the barrel 104 from the handle 102 and disconnecting the collar 120 and the dip tube 118 from the reservoir 110. During use, the "clear" portion of the reservoir 110 and window-like structure 102B permit a user to visually and conveniently inspect a fluid level of the reservoir 110 without disassembling the device 100.

Still referring to FIGS. 3–4, the pressurized gas cartridge 136 is disposed within the chamber 102A of the handle 102 posterior to the reservoir 110. The cartridge 136 is configured to contain a volume of compressed gas and is further configured to discharge a volume of compressed gas when its interior is accessed. The cartridge 136 can include, but is not limited to, a compressed air, $N_2O$ or $CO_2$-filled cartridge. The cartridge 136 is portable and can range in volume of from about 5 grams to about 25 grams. The size (volume) of the cartridge 136 is only limited to accommodate a size of the chamber 102A and the handle 102, and a practical size of the hairbrush device 100.

Figure 6:
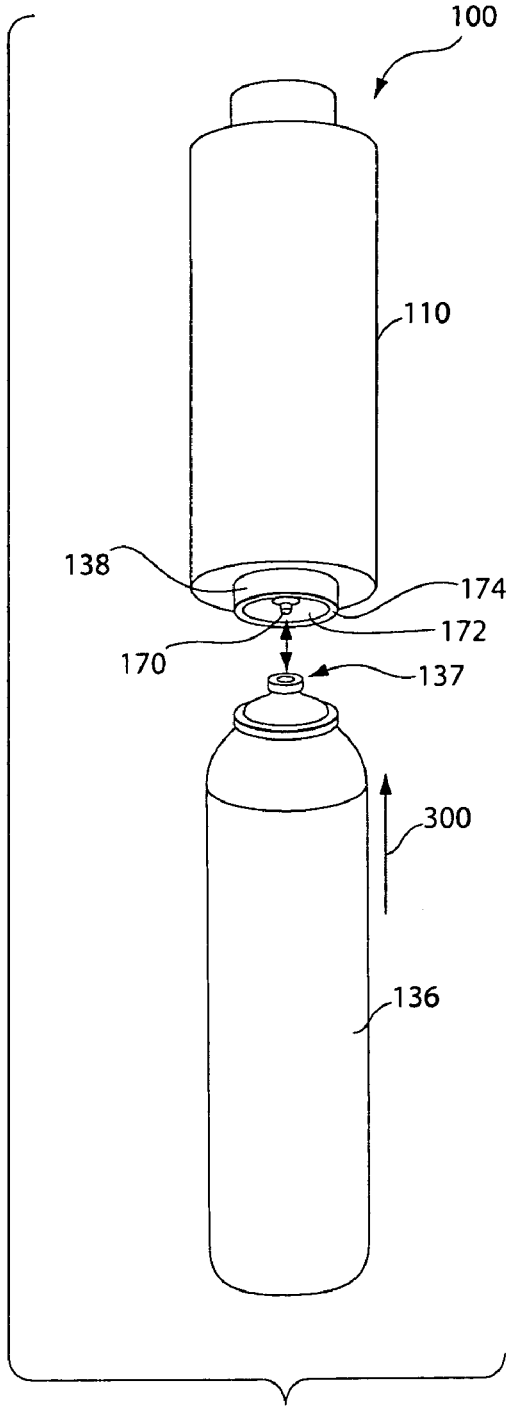
FIG. 6 is a perspective view of a fluid reservoir and a pressurized gas cartridge of the fluid misting assembly shown in FIGS. 3–4.

Referring to FIG. 6, and with further reference to FIG. 4, the handle 102 and its interior components are assembled in part by insertion of the cartridge 136 into the chamber 102A of the handle 102. The cartridge 136 includes a size and shape for insertion of the cartridge 136 into the proximal end of the handle 102. When the cartridge 136 is inserted into the chamber 102A, the cartridge 136 is coupled to the proximal end of the reservoir 110. With assistance provided by an outer intake valve guide 138 and an inner intake valve guide 174, each defined in the proximal end of the reservoir 110 and configured to help to guide and position the cartridge 136, the inner and the outer intake valve guides 138, 174 help to removably couple and to securely connect the cartridge 136 to the reservoir 110 to thereby insure a proper connection between the cartridge 136 and the reservoir 110.

With further reference to FIG. 4, a cap 130, configured to couple with the proximal end of the handle 102, defines a set of threads along its interior surface that couple and mate with a corresponding set of threads defined in the handle 102 adjacent to its proximal end. When the cap 130 couples with the proximal end of the handle 102 and is rotated in one direction, such rotating motion causes the sets of threads to mate, thereby connecting the cap 130 to the handle 102.

The rotating motion of the cap 130 effectively tightens the cap 130 to the handle 102, while simultaneously forcing the cartridge 136 forward toward the proximal end of the reservoir 110, as shown by arrow 300 in FIG. 6. A spring 162 disposed in an inner surface of the cap 130 is configured to bias against the cartridge 136 and to help the cartridge 136 advance forward when the cap 130 is coupled to the handle 102 and is rotated to secure the cap 130 thereon. The spring 162 is further disposed and configured to be removed from the cap 130 and replaced with a spring having a different size such that the cap 130 and the spring 162 combination accommodate different sizes of cartridges 136.

Once inserted into the chamber 102A of the handle 102, the rotating motion of the cap 130 forces the cartridge 136 forward toward and into the outer and the inner intake valve guides 138, 174 whereby it couples with the guides 138, 174 and the proximal end of the reservoir 110. The cartridge 136 initially engages the outer guide and then the inner guide 174, which is defined by a perimeter of the outer guide 138. As shown in FIG. 6, in one embodiment, the inner and the outer intake valve guides 138, 174 define substantially circular guides wherein the inner guide 174 is disposed within the outer guide 138, and each guide 138, 174 accommodates a distal portion of the cartridge 136. The rotating motion of the cap 130 and the guidance of the outer and the inner guides 138, 174 help to position the distal end of the cartridge 136 substantially over a flexible membrane 172 disposed within the inner guide 174.

The distal end of the cartridge 136 is further configured as a tapered end 137. In one embodiment, a dam-like membrane (not shown) is disposed within the distal end of the cartridge 136 or within the tapered end 137 such that, when the cartridge 136 is coupled to the proximal end of the reservoir 110, as described below, the membrane is broken to place an interior of the cartridge 136 in fluid communication with the reservoir 110 interior. The membrane can be constructed of any material suitable for piercing including, but not limited to, metal.

When coupled to the proximal end of the reservoir 110, the cartridge 136 is disposed over the membrane 172. Once the cartridge 136 is positioned over the membrane 172, additional rotation of the cap 130 causes the tapered end 137 to move forward to contact a piercing element 170, e.g., an intake valve, disposed along, e.g., a center, of the membrane 172. The piercing element or intake valve 170 is disposed and configured to receive the tapered end 137. When the valve 170 receives the tapered end 137 as a result of the forward movement, the valve 170 pierces the dam-like membrane of the cartridge 136. The intake valve 170 and the tapered end 137 are thereby connected. The valve 170 and the tapered end 137 effectively place the interior of the cartridge 136 in fluid communication with the interior of the reservoir 110. Pressurized gas contained within the cartridge 136 can discharge from the cartridge 136 into the reservoir 110 interior to thereby pressurize the interior and the fluid contents contained therein. As long as the cartridge 136 contains a pressurized (compressed) gas, and remains connected to the reservoir 110 and in fluid communication with its interior, the reservoir 110 interior and its fluid contents remain pressurized. Actuating the switch 134, as noted above, effectively actuates the actuator valve 122, which causes a release of pressure from the pressurized reservoir 110 interior and a consequence discharge of a volume of fluid therefrom.

With further reference to FIGS. 1–2, the barrel 104 and the handle 102 may be constructed of a material suitable for permitting the device 100 to be easily manipulated manually and for withstanding moist and wet conditions. A suitable material is lightweight and does not add significant weight to the device 100, thereby permitting the device 100 to be portable and easily transported. A suitable material provides sufficient strength such that the material can withstand wear and tear of such operations as engaging and disengaging the barrel 104 and the handle 102. In particular, portions of the barrel 104 and the handle 102 defining the chambers 104B and 102A, as well as the cap 130, that are configured to position the reservoir 110 and the cartridge 136 within the device 100 are constructed of such a material suitable for withstanding moist and wet conditions and wear and tear associated with assembly and disassembly of the device 100. In addition, one or more components of the fluid misting assembly 101 can be constructed of a material suitable for providing those physical properties and characteristics described above. The outer and the inner intake valve guides 138, 174 are constructed of a material suitable for withstanding the engagement and disengagement of the cartridge 136 to the reservoir 110. Also, the nozzle 116, the dip tube 118 and the collar 120 can be similarly constructed of such a material suitable for providing such properties noted. A suitable material includes, but is not limited to, rubber, plastic, metal, wood or a combination thereof.

Figure 7:
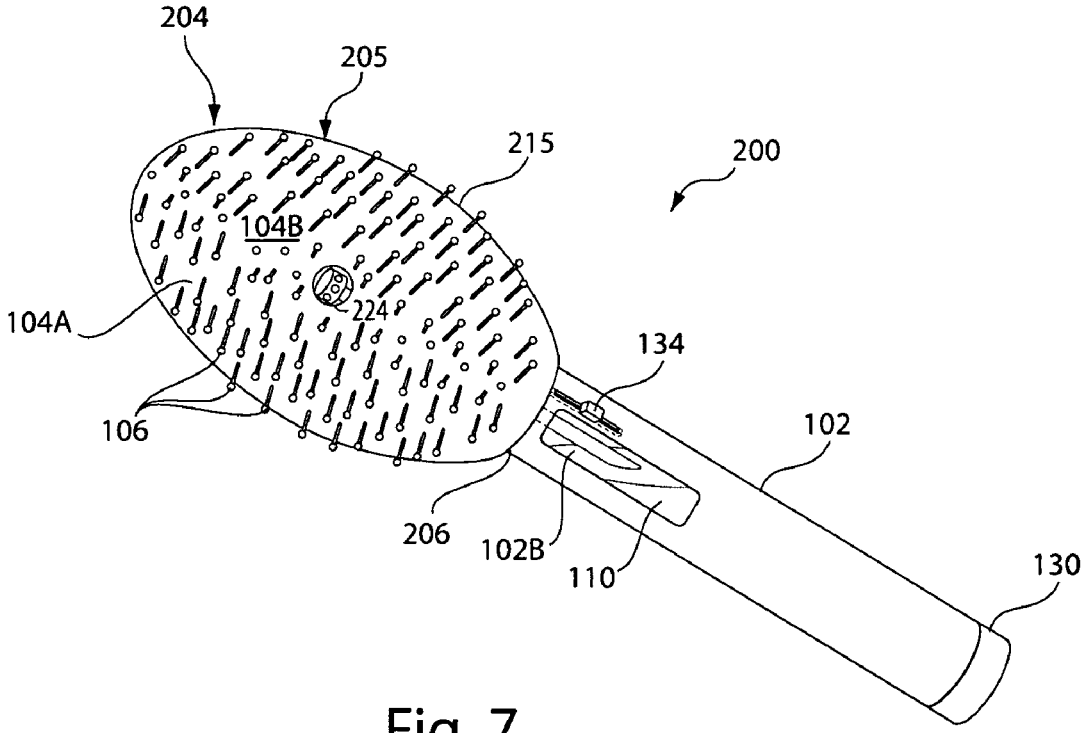
FIG. 7 is a perspective view of another embodiment of the fluid dispensing device according to the invention.
Figure 8:
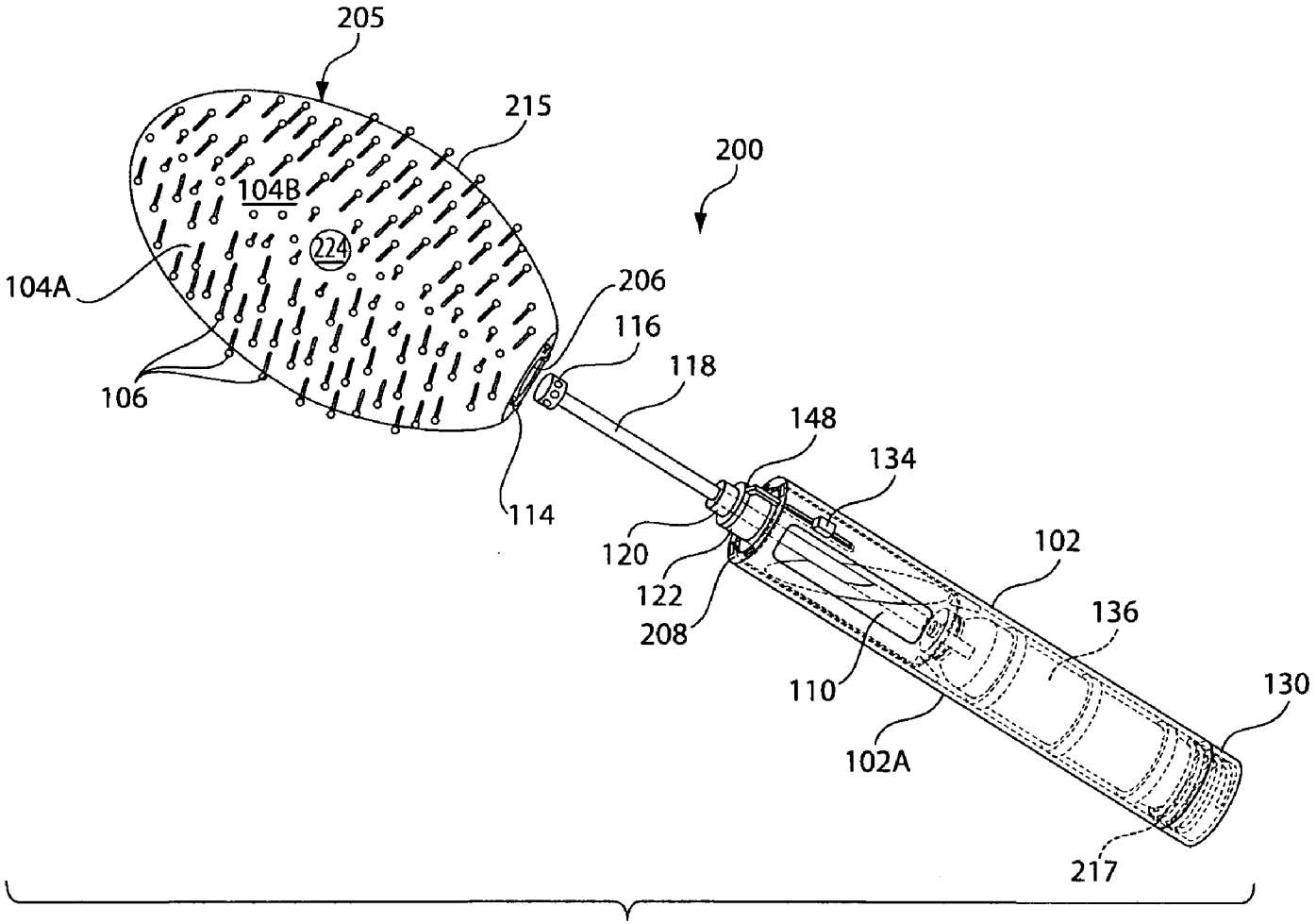
FIG. 8 is an exploded perspective view of the device shown in FIG. 7 illustrating the barrel including the plurality of bristles disengaged from the handle.

Referring to FIGS. 7–8, another embodiment of the invention provides a portable, cordless pressurized fluid dispensing device 200 configured as a hairbrush and including those elements and components described above with reference to the device 100 and FIGS. 1–6. As shown in FIG. 7, the device 200 includes the barrel 104 configured in a paddle-like conformation. In this embodiment, the paddle-like barrel 104 has a first outer surface 204 and a second outer surface 205 (not shown). The first outer surface 204 defines a dispensing opening 224 in fluid communication with the chamber 104B of the barrel 104 and further provides the plurality of bristles 106 projecting therefrom.

The proximal end 113 of the paddle-like barrel 104 is similarly constructed to that of the device 100 shown in FIGS. 1–2, and includes an opening 114 and one or more notches 206 defined along a portion of an inner surface of the barrel chamber 104B. The one or more notches 206 are disposed and configured to couple with one or more corresponding notches 208 defined along a surface of the distal end 115 of the handle 104. The notches 206 of the barrel 104 and the notches 208 of the handle 102 are disposed and configured such that each notch 206, 208 inserts into an area defined by adjacent pairs of notches 206, 208. In other words, adjacent pairs of notches 206, 208 define an area sized and configured to receive one of the opposing corresponding notches 206, 208.

Where the fluid misting assembly 101 is substantially assembled and the barrel 104 and the handle 102 are engaged, the nozzle 116 is disposed within the chamber 104B of the barrel 104 such that it is substantially adjacent to and aligned with the dispensing opening 224 in the outer surface 104A of the barrel 104. In one embodiment, the dispensing opening 224 is sized and configured to receive the nozzle 116. The nozzle 116 is correspondingly configured and disposed in the chamber 104B such that the dispensing opening 224 receives the nozzle 116 when the nozzle 116 is connected to the reservoir 110, e.g., via the dip tube 118. In this configuration the nozzle 116 dispenses a fluid spray or mist through the dispensing opening 224.

Other embodiments are within the scope and spirit of the invention. For example, the device 100, 200, with or without the plurality of bristles 112, can be configured as a kitchen utensil, such as a cooking oil/melted butter dispensing pastry brush or a cooking oil/melted butter-basting device. The device 100, 200 can be further configured, for example, as a hardware device, such as a paint-dispensing device. In these cases, the reservoir 110 size can be adjusted to accommodate, if necessary, a larger volume of fluid for dispensing, as well as the size of the cartridge 136 to provide sufficient compressed gas to pressurize and discharge a larger volume of fluid. In addition, the openings 112, 224, the nozzle 116 and the dip tube 118 can be sized and configured appropriately to accommodate such viscous fluids as cooking oil, melted butter and paint, and to allow such fluids to pass through these components and to be delivered as a fluid spray or mist from the device 100, 200.

Other embodiments can include, for example, the device 100, 200 configured for incorporation with or configured as a children's water-squirting toy, a personal device, e.g., a portable water misting/cooling fan, or as another personal grooming device, e.g., a fragrance dispenser, to dispense a cosmetic fluid as a mist.

Having thus described at least one illustrative embodiment of the invention, various alterations, modifications and improvements will readily occur to those skilled in the art. Such alterations, modifications and improvements are intended to be within the scope and spirit of the invention. Accordingly, the foregoing description is by way of example only and is not intended as limiting. The invention's limit is defined only in the following claims and the equivalents thereto.

What is claimed is:

1. A fluid dispensing brush comprising:

a barrel portion defining a first chamber and a handle portion operatively connected to the barrel portion and defining a second chamber, the barrel portion having a plurality of openings defined in at least a portion of its outer surface in fluid communication with the first chamber and a plurality of bristles projecting therefrom;

a fluid assembly contained in the second chamber of the handle portion, the fluid assembly including an enclosed fluid reservoir configured to maintain a quantity of fluid under pressure and an enclosed gas pressure cartridge operatively connected to a proximal end of the fluid reservoir such that a first interior chamber defined within the fluid reservoir and a second interior chamber defined within the gas pressure cartridge are in fluid communication when the fluid reservoir and the gas pressure cartridge are operatively connected, the gas pressure cartridge being constructed and arranged to discharge a volume of pressurized gas from the second interior chamber to the first interior chamber of the fluid reservoir to thereby continuously pressurize the first interior chamber of the fluid reservoir and any fluid contents of the fluid reservoir when the gas pressure cartridge is operatively connected to the fluid reservoir and until pressurized gas is depleted from the gas pressure cartridge;

an actuator disposed along an outer surface of the handle portion such that the actuator is operatively connected to an actuator valve defined in a distal end of the fluid reservoir, the actuator being further disposed and configured such that when actuated the actuator actuates the actuator value to discharge a volume of pressure from the pressurized fluid reservoir such that a volume of fluid contents is discharged from the pressurized fluid reservoir; and a nozzle extending from the first interior chamber of the fluid reservoir and contained in the first chamber of the barrel portion, the nozzle having one or more holes defined in at least a portion of its outer surface along a terminal portion, each hole being in fluid communication with the first chamber, the nozzle being configured and connected to the pressurized fluid reservoir such that the nozzle receives at least a portion of the volume of fluid contents discharged from the pressurized fluid reservoir and the one or more holes discharge the volume of fluid contents into the first chamber as at least one of a fluid spray and a fluid mist, wherein the plurality of openings vents the fluid spray or mist from the brush.

2. The brush of claim 1, wherein movement of the actuator from a first position to a second position actuates the actuator.

3. The brush of claim 1, wherein the pressurized gas is selected from the group consisting of compressed air, compressed $N_2O$ and compressed $CO_2$.

4. The brush of claim 1, wherein each of the one or more holes of the nozzle is sized and configured, and wherein the actuator valve is further configured to discharge the volume of pressure with sufficient force, such that the nozzle discharges the volume of fluid contents as at least one of fine fluid droplets and ultra-fine fluid droplets.

5. The brush of claim 4, wherein each of the one or more holes has a span of from about 0.4 mm to about 1.0 mm.

6. The brush of claim 1, wherein each of the one or more holes of the nozzle is sized and configured, and wherein the actuator valve is further configured to discharge the volume of pressure with sufficient force, such that the nozzle discharges the volume of fluid contents as at least one of an atomized fluid spray and an atomized fluid mist.

7. The brush of claim 1, wherein the nozzle further includes a hollow elongated tube configured to extend from the first chamber into the second chamber, and further configured to place an interior of the nozzle in fluid communication with the first interior chamber of the fluid reservoir.

8. The brush of claim 1, wherein each of the barrel portion and the handle portion are configured such that the barrel portion is removably connected to the handle portion.

9. The brush of claim 1, wherein the barrel portion defines a circular cylinder.

10. The brush of claim 9, wherein the plurality of bristles is distributed along the outer surface of the cylinder such that the plurality of bristles defines a round brush.

11. The brush of claim 9, wherein the plurality of openings is distributed along the outer surface of the cylinder such that the fluid vents from a circumferential perimeter of the circular cylinder.

12. The brush of claim 1, wherein the barrel portion defines a paddle-shaped conformation having a first side and a second side, wherein the plurality of bristles and the plurality of openings are disposed along at least a portion of the first side.

13. The brush of claim 1, wherein the handle portion defines a circular cylinder.

14. A fluid dispensing brush comprising:

a barrel portion defining a first chamber and a handle portion defining a second chamber, the barrel portion and the handle portion being operatively connected;

at least a portion of an outer surface of the barrel portion defining a plurality of openings in fluid communication with the first chamber and having a plurality of bristles projecting therefrom;

first means contained within the second chamber to contain a quantity of fluid;

second means contained within the second chamber to apply pressure to the quantity of fluid wherein said means is operatively connected to said means to contain a quantity of fluid;

means contained within the second chamber to discharge a volume of fluid from said means to contain a quantity of fluid; and means contained within the first chamber to receive at least a portion of the volume of fluid discharged and to vent the volume of fluid through the plurality of openings.

15. The brush of claim 1, wherein the terminal portion of the nozzle further includes a dispensing valve constructed and arranged such that a span of each of one or more holes is adjustable.

16. The brush of claim 15, wherein the dispensing valve is constructed and arranged such that rotation of the terminal portion of the nozzle adjusts a span of each of one or more holes.

17. A fluid dispensing brush comprising:

a barrel portion defining a first chamber and a handle portion operatively connected to the barrel portion and defining a second chamber;

a plurality of dispensing apertures defined in at least a portion of an outer surface of the barrel portion, the plurality of dispensing apertures being in fluid communication with the first chamber;

a plurality of bristles disposed along and projecting from at least a portion of the outer surface of the barrel portion;

a fluid reservoir and a gas pressure cartridge disposed within the second chamber of the handle portion, the fluid reservoir and the gas pressure cartridge being operatively connected such that a first interior chamber of the fluid reservoir and a second interior chamber of the gas pressure cartridge are in fluid communication, the first interior chamber being configured to contain fluid contents and to receive a supply of pressurized gas from the second interior chamber of the gas pressure cartridge; and a nozzle assembly extending from the first interior chamber of the fluid reservoir into the first chamber of the barrel portion, the nozzle assembly having a terminal portion with a plurality of dispensing apertures defined along at least a portion of its outer surface, the plurality of dispensing apertures being in fluid communication with the first interior chamber of the fluid reservoir and the first chamber of the barrel portion.

18. The brush of claim 17 wherein the terminal portion of the nozzle assembly further includes a valve, the valve being constructed and arranged to adjust a span of one or more dispensing apertures.

19. The brush of claim 18 wherein the valve includes a manually actuated valve.

20. The brush of claim 18 wherein a span of one or more dispensing apertures includes a range of from about 0.4 mm to about 1.0 mm.

21. The brush of claim 18 wherein the handle portion includes at its proximal end a cap portion, the cap portion being removably connected to the handle portion to permit access to the second chamber when removed from the handle portion.

22. The brush of claim 21 wherein the gas pressure cartridge is removably connected to the fluid reservoir.

23. The brush of claim 22 wherein the cap portion further includes a bias mechanism such that when the cap portion is attached to the handle portion, the bias mechanism abuts the gas pressure cartridge to dispose the gas pressure cartridge in operable connection with the fluid reservoir.

24. The brush of claim 17 further comprising an actuator switch disposed along an outer surface of the handle portion and further disposed such that when the actuator switch is actuated a volume of pressure and a volume of fluid are discharged from the first interior chamber of the fluid reservoir.

25. The brush of claim 17 further comprising at least a portion of a surface of the handle portion is constructed of at least one of a translucent material and a transparent material to permit visual inspection of the second chamber.

26. The brush of claim 17 further comprising at least a portion of a surface of the fluid reservoir is constructed of at least one of a translucent material and a transparent material to permit visual inspection of the first interior chamber.

* * * * *

UNITED STATES PATENT AND TRADEMARK OFFICE

CERTIFICATE OF CORRECTION

PATENT NO. : 7,011,468 B1
DATED : March 14, 2006
INVENTOR(S) : Leventhal

It is certified that error appears in the above-identified patent and that said Letters Patent is hereby corrected as shown below:

Column 17,
Line 19, change "value" to read -- valve --.

Signed and Sealed this

Twenty-third Day of May, 2006

JON W. DUDAS
*Director of the United States Patent and Trademark Office*